US010166591B2

(12) United States Patent
Babbitt et al.

(10) Patent No.: US 10,166,591 B2
(45) Date of Patent: Jan. 1, 2019

(54) FORMING APPARATUS

(75) Inventors: Terry Babbitt, Lynchburg, VA (US); Nageswara Nagisetty, Lynchburg, VA (US); Dennis Green, Lynchburg, VA (US)

(73) Assignee: Belvac Production Machinery, Inc., Lynchburg, VA (US)

( * ) Notice: Subject to any disclaimer, the term of this patent is extended or adjusted under 35 U.S.C. 154(b) by 1162 days.

(21) Appl. No.: 14/357,350

(22) PCT Filed: Nov. 9, 2011

(86) PCT No.: PCT/US2011/059866
§ 371 (c)(1),
(2), (4) Date: Oct. 30, 2014

(87) PCT Pub. No.: WO2013/070199
PCT Pub. Date: May 16, 2013

(65) Prior Publication Data
US 2015/0082849 A1 Mar. 26, 2015

(51) Int. Cl.
*B21D 51/26* (2006.01)

(52) U.S. Cl.
CPC ..... *B21D 51/2669* (2013.01); *B21D 51/2646* (2013.01); *B21D 51/2692* (2013.01)

(58) Field of Classification Search
CPC .... B21D 51/10; B21D 51/26; B21D 51/2615; B21D 51/2623; B21D 51/2669; B21D 51/2692; B21D 51/2638; B21D 51/2646
See application file for complete search history.

(56) References Cited

U.S. PATENT DOCUMENTS 2,686,551 A 4/1951 Laxo
3,096,709 A 7/1963 Eldred et al.
(Continued)

FOREIGN PATENT DOCUMENTS

WO WO 2010/099081 A1 9/2010
WO WO 2013/070199 A1 5/2013

OTHER PUBLICATIONS

International Search Report dated Mar. 27, 2012, which issued in corresponding International Patent Application No. PCT/US2011/059866 (3. pages).
(Continued)

*Primary Examiner* — Pradeep C Battula
(74) *Attorney, Agent, or Firm* — Nixon Peabody LLP

(57) ABSTRACT

A rotatable forming apparatus and a method for modifying a shape of a container. The rotatable forming apparatus includes a frame and a forming turret assembly. The forming turret assembly includes a drive shaft, a fixed turret portion, a turret starwheel, an axially moveable turret portion and forming ram assemblies. The forming ram assemblies extend around and connect to the axially movable turret portion. Each of the forming ram assemblies includes cam followers, a forming die, a knockout tooling device and a drive cylinder. The cam followers are configured to follow the cam as the forming ram assemblies rotate around the stationary cam. The forming die is operatively connected to the cam followers such that the forming die moves in the vertical direction while following the cam. The drive cylinder causes axial movement of the knockout tooling device and is configured to operate independently of the forming die.

13 Claims, 17 Drawing Sheets

(56) References Cited

U.S. PATENT DOCUMENTS

| | | | | |
|---|---|---|---|---|
| 4,519,232 | A | 5/1985 | Traczyk et al. | |
| 6,752,000 | B2 * | 6/2004 | Reynolds | B21D 51/2615 72/352 |
| 7,310,983 | B2 * | 12/2007 | Schill | B21D 51/2615 72/405.03 |
| 7,530,445 | B2 | 5/2009 | Marshall et al. | |
| 7,886,551 | B2 | 2/2011 | Schill et al. | |
| 2007/0217618 | A1 | 8/2007 | Yang et al. | |
| 2010/0212130 | A1 * | 8/2010 | Marshall | B21D 51/26 29/35.5 |

OTHER PUBLICATIONS

Written Opinion dated Mar. 27, 2012, which issued in corresponding International Patent Application No. PCT/US2011/059866 (5. pages).

* cited by examiner

FORMING APPARATUS

CROSS-REFERENCE TO RELATED APPLICATIONS

This application is a U.S. national stage of International Patent Application No. PCT/US2011/059866, filed Nov. 9, 2011, the contents of which is incorporated entirely herein by reference.

BACKGROUND

Field of Embodiments

The present embodiments relate generally to a rotating forming apparatus for modifying a shape of a container and to a method for modifying a shape of a container.

Description of Related Art

Conventional forming apparatuses have been used to modify the shape of a container (e.g. a can, food or beverage container, jar). Limited components, such as the turret assembly, starwheels and forming die, on conventional forming apparatus move in an indexing manner such that indexing and forming are not performed simultaneously. Indexing refers to moving a container to a first fixed position, storing the container in the first fixed position until a given process ends, moving the container from the first fixed position to a second fixed position for the next process to start and so on. As a result of indexing and forming not being performed simultaneously, conventional forming apparatuses prevent continuous high speed rotation of the forming apparatus. Consequently, conventional forming apparatuses neck only about 200 containers per minute.

A need exits for a rotatable forming apparatus that modifies the shape of a container and a method of modifying the shape of a container that address one or more of the above described disadvantages. A need also exists for a rotatable forming apparatus that modifies the shape of a container and a method of modifying the shape of a container that allows easy access to forming dies, assembly and maintenance.

SUMMARY

One embodiment relates to a rotatable forming apparatus for modifying a shape of a container that comprises a frame and a forming turret assembly. The frame has a lower base and an upper base. The forming turret assembly connects to the frame and includes a drive shaft, a fixed turret portion, a turret starwheel, an axially moveable turret portion and forming ram assemblies. The drive shaft extends in a vertical direction along a longitudinal axis from the lower base to the upper base. The fixed turret portion extends in the vertical direction along the drive shaft. The turret starwheel is coaxial with the drive shaft and is configured to receive the container. The axially movable turret portion extends in the vertical direction along the drive shaft and above the fixed turret portion. The axially moveable turret portion includes a cam and an adjustment mechanism configured to adjust the axially moveable turret portion in the vertical direction along the drive shaft with respect to the fixed turret portion so as to configure the forming turret assembly readily adjustable for containers of different lengths. The forming ram assemblies extend around and connect to the axially movable turret portion. Each of the forming ram assemblies includes cam followers, a forming die, a knockout tooling device and a drive cylinder. The cam followers are configured to follow the cam as the forming ram assemblies rotate around the stationary cam. The forming die is operatively connected to the cam followers such that the forming die moves in the vertical direction while following the cam. The drive cylinder causes axial movement of the knockout tooling device and is configured to operate independently of the forming die.

Another embodiment relates to a method for modifying a shape of a container. The method comprises feeding the container into a first forming turret assembly that includes a first axially moveable turret portion and first forming ram assemblies extending around and connected to the first axially movable turret portion. Each of the first forming ram assemblies includes a first drive cylinder, a first forming die and a first knockout tooling device. The method also comprises activating the first drive cylinder to cause axial movement of the first knockout tooling device in a vertical direction and activating the first forming die independently of the activated first drive cylinder to cause axial movement of the first forming die in the vertical direction and rotational movement of the first forming die. Additionally, the method comprises transferring the container from the first forming turret assembly to a second forming turret assembly. The second forming turret assembly includes a second axially moveable turret portion and second forming ram assemblies extending around and connected to the second axially movable turret portion. Each of the second forming ram assemblies includes a second drive cylinder, a second forming die that is different from the first forming die and a second knockout tooling device. The method additionally comprises activating the second drive cylinder to cause axial movement of the second knockout tooling device in the vertical direction and activating the second forming die independently of the activated second drive cylinder to cause axial movement of the second forming die in the vertical direction and rotational movement of the second forming die.

BRIEF DESCRIPTION OF THE DRAWINGS

These and other features, aspects and advantages of the disclosed embodiments will become apparent from the following description, appended claims and the accompanying exemplary embodiments shown in the drawings, which are briefly described below.

DETAILED DESCRIPTION

Figure 1A:
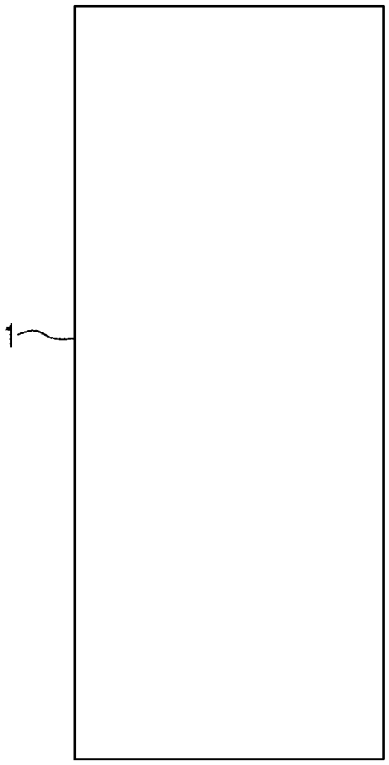
FIG. 1*a* is a side view of a container before the container enters the rotatable forming apparatus.

Embodiments are illustrated in the drawings. The disclosure relates to a rotatable forming apparatus for modifying a shape of a container (e.g. a can, food or beverage container, jar) and a method of modifying a shape of a container (e.g. a can, food or beverage container, jar). For the purposes of this application, a container may refer to one or more containers.

Figure 1B:
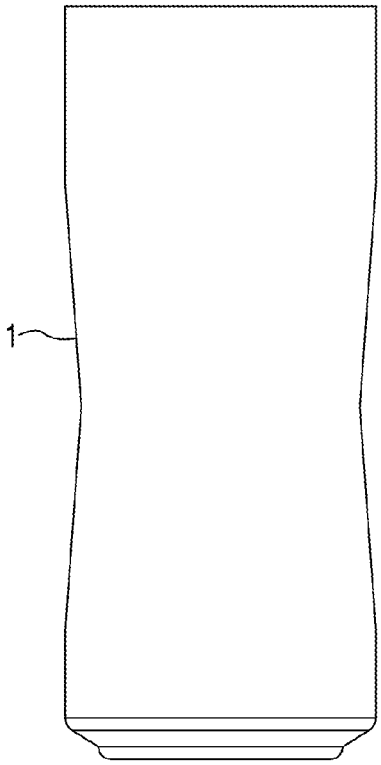
FIG. 1*b* is a front view of the container of FIG. 1*a* after the container exits the rotatable forming apparatus.

Machines may be used to form, process or otherwise perform an action on a container 1 (FIGS. 1A and 1B) such that the shape of the container 1 is modified from a first shape, such as shown in FIG. 1A, to a second shape, such as shown in FIG. 1B. In a multi-stage line, a container 1 is first fed into a first stage (e.g. a rotatable forming apparatus) to enter pockets in a turret/starwheel. Each starwheel may have any number of pockets to hold containers for processing and transfer. For example, a starwheel may have six, eight, ten, twelve, fourteen, sixteen, eighteen, twenty pockets to hold six, eight, ten, twelve, fourteen, sixteen, eighteen, twenty containers, respectively. It will be recognized that the starwheel is capable of having one pocket up to any suitable number of pockets. After exiting the first stage, the container 1 may enter a second stage.

Figure 22:
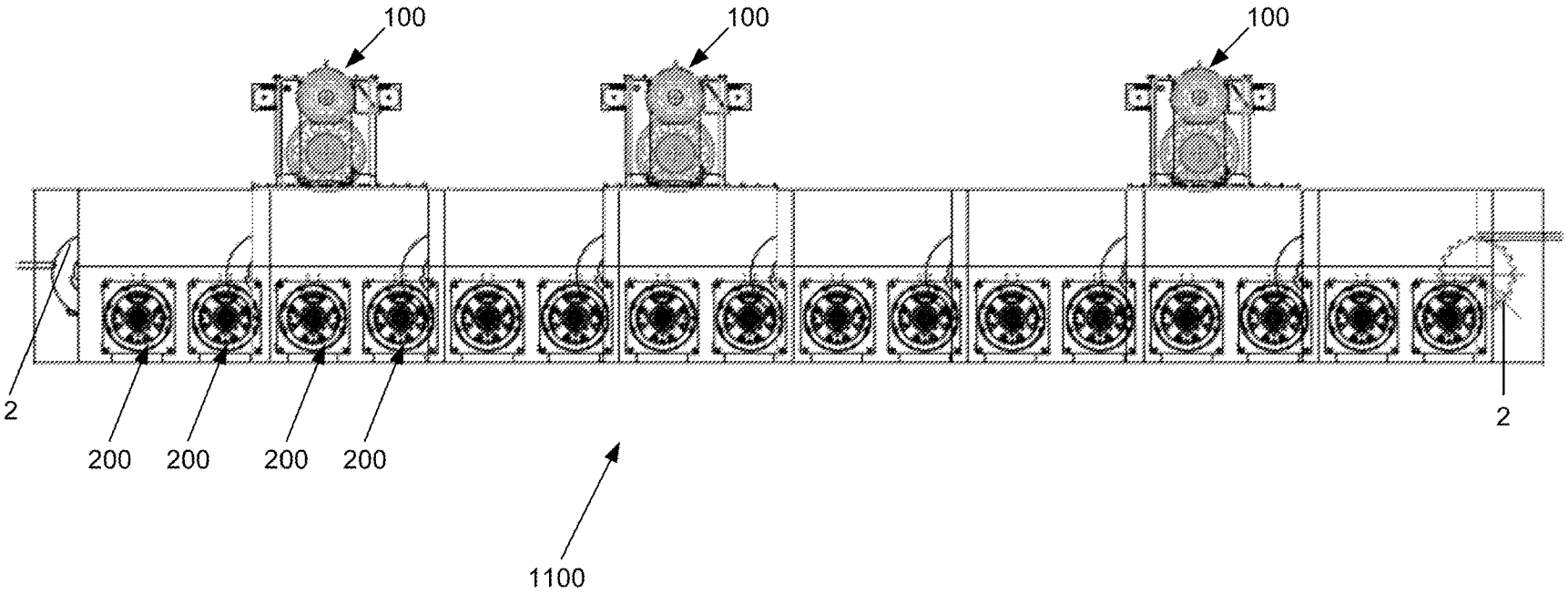
FIG. 22 is a top view of a rotatable forming apparatus for an in-line system.

Once fed into the multi-stage line, the container 1 is processed through any number of stages, e.g. a necking stage, a curling stage, an expansion stage or any other suitable process or forming stage. When the container passes through all process/forming stages, the container is discharged from the machine. In embodiments, the multi-stage line may be a recirculating system or an in-line system 1100 (FIG. 22).

Figure 2:
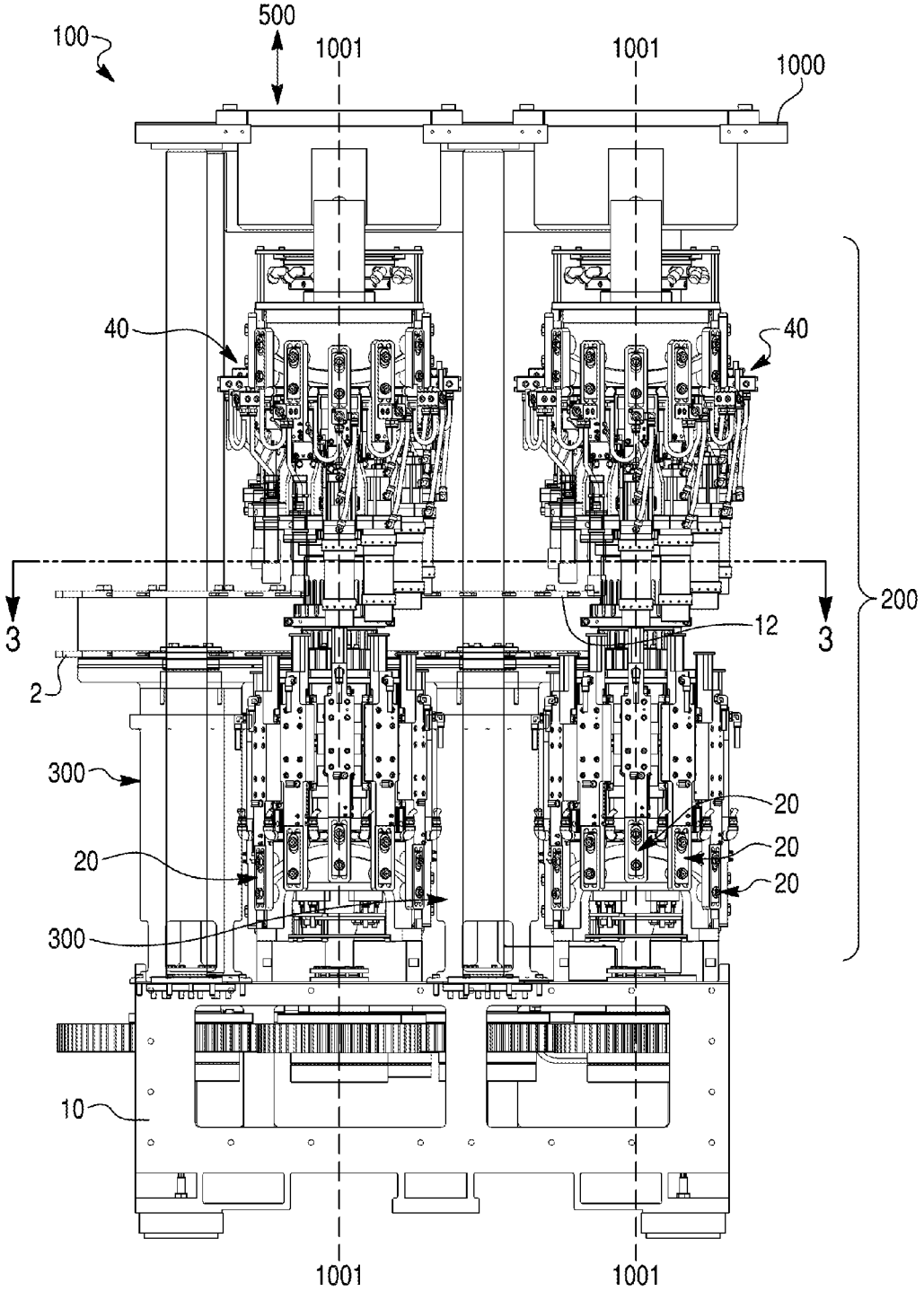
FIG. 2 is a front elevated view of a portion of a rotatable forming apparatus.
Figure 8:
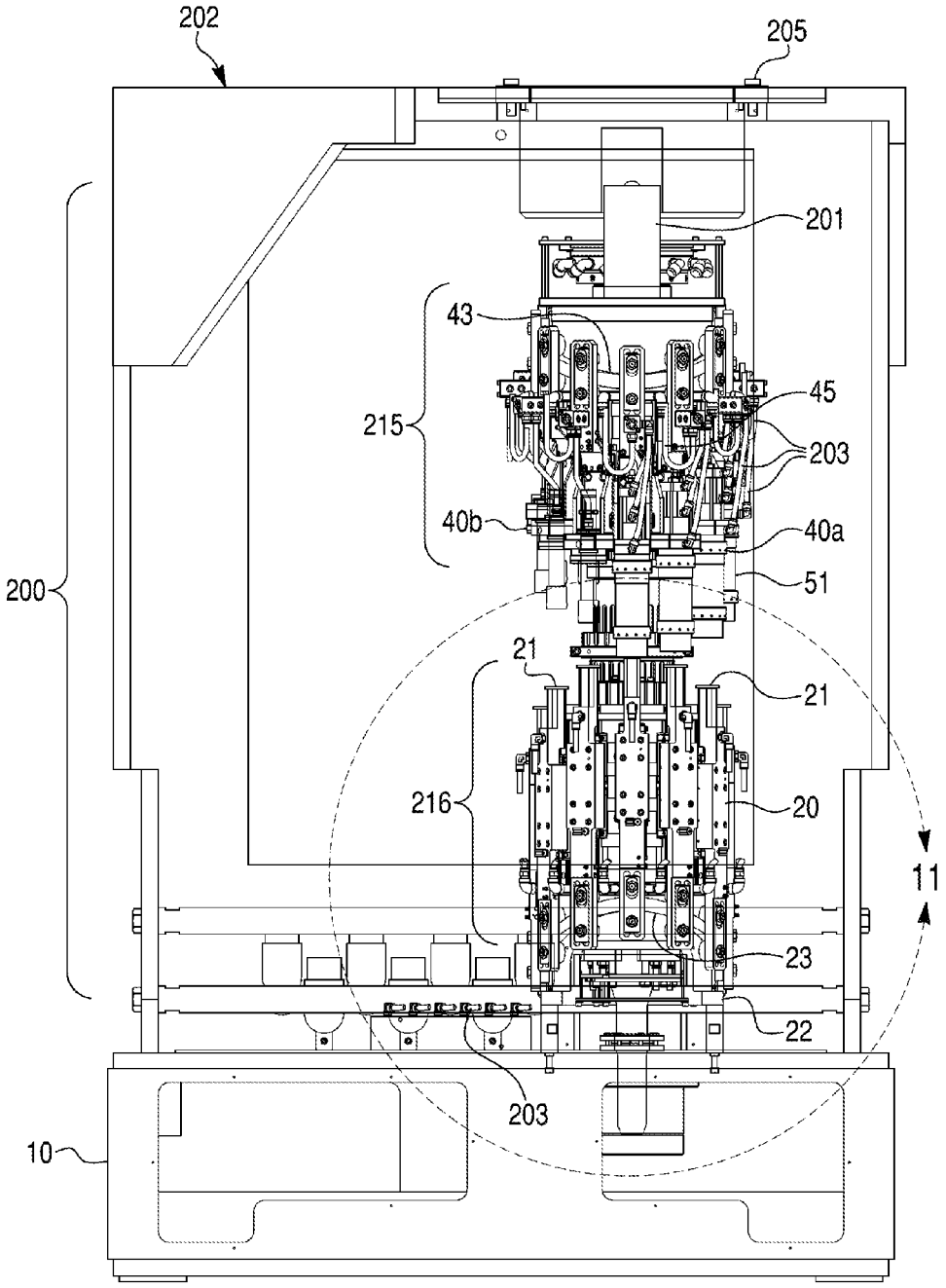
FIG. 8 is a side view of a forming turret assembly of a rotatable forming apparatus and a portion of the frame of the rotatable forming apparatus.
Figure 9:
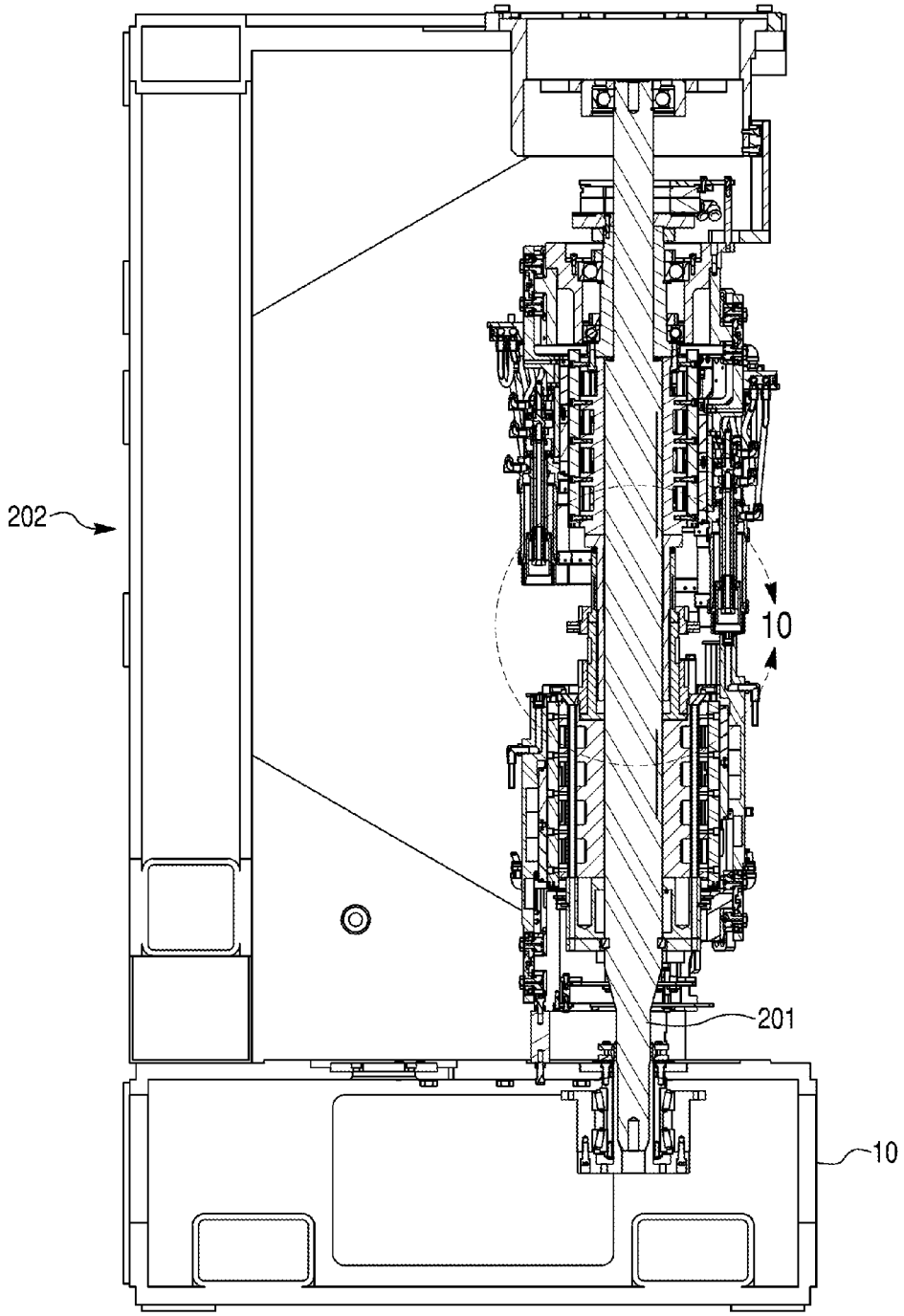
FIG. 9 is a cross-sectional view of the forming turret assembly of FIG. 8.

Referring to FIGS. 2-11, a rotatable forming apparatus 100 for modifying a shape of a container 1 may comprise a frame 202 (FIGS. 8-9) and a forming turret assembly 200 connected to the frame 202. The frame 202 includes a lower base 10 and an upper base 1000 (FIGS. 2 and 8-9). The forming turret assembly 200 may include a drive shaft 201 (FIG. 8), a fixed turret portion 216, a turret starwheel 102, an axially moveable (e.g. adjustable) turret portion 215 forming ram assemblies 40. The forming turret assembly 200 may also include push ram assemblies 20 (FIGS. 2-3, 8-9 and 11). The fixed turret portion 216 may be referred to as a push ram block and the axially moveable turret portion 215 may be referred to as a forming ram block, an adjustable moveable turret portion or an axially adjustable moveable turret portion.

Figure 3:
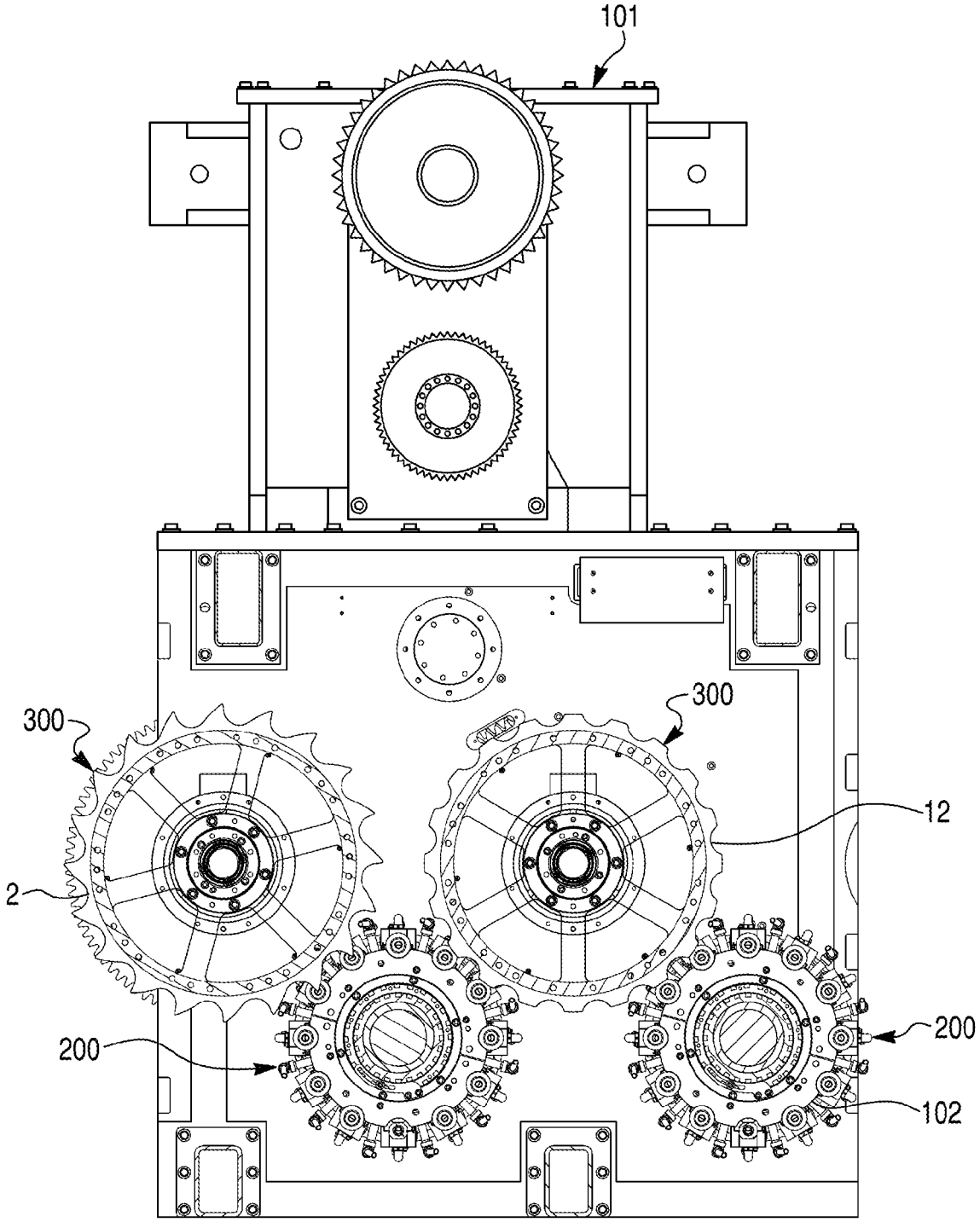
FIG. 3 is a cross-sectional view of FIG. 2 along line 3-3.
Figure 4:
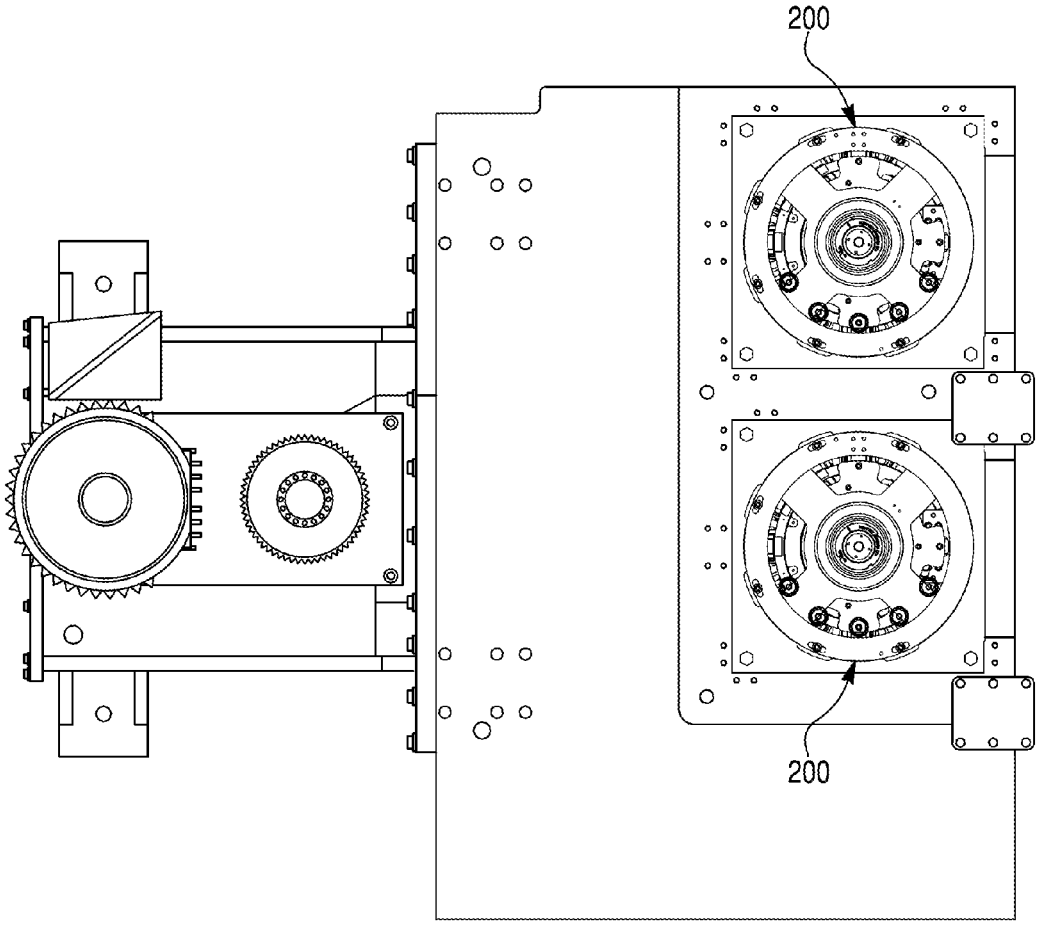
FIG. 4 is a top view of FIG. 2.
Figure 5:
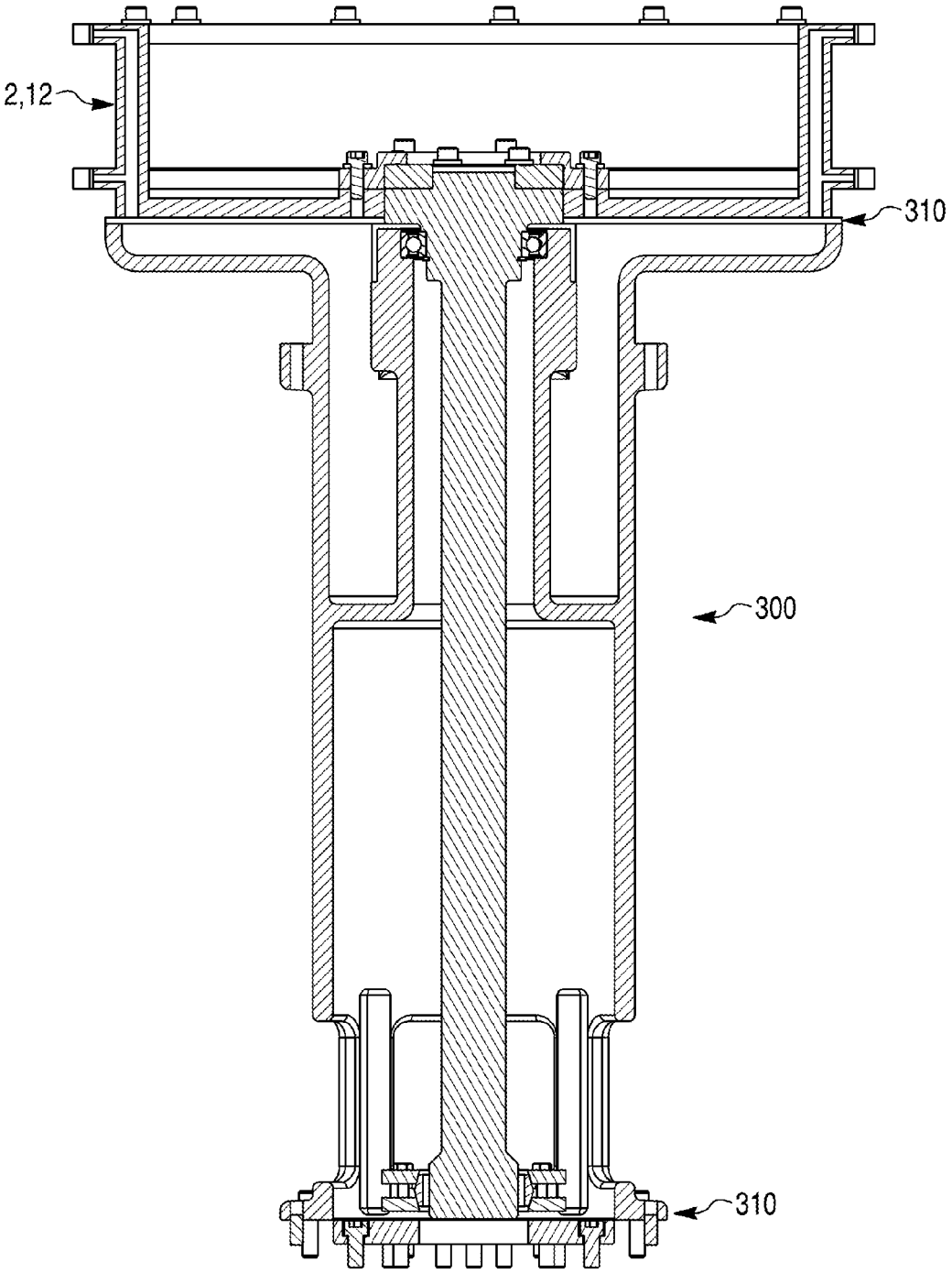
FIG. 5 is a cross-sectional view of a transfer turret assembly, having a transfer starwheel or infeed starwheel of a rotatable forming apparatus.
Figure 7:
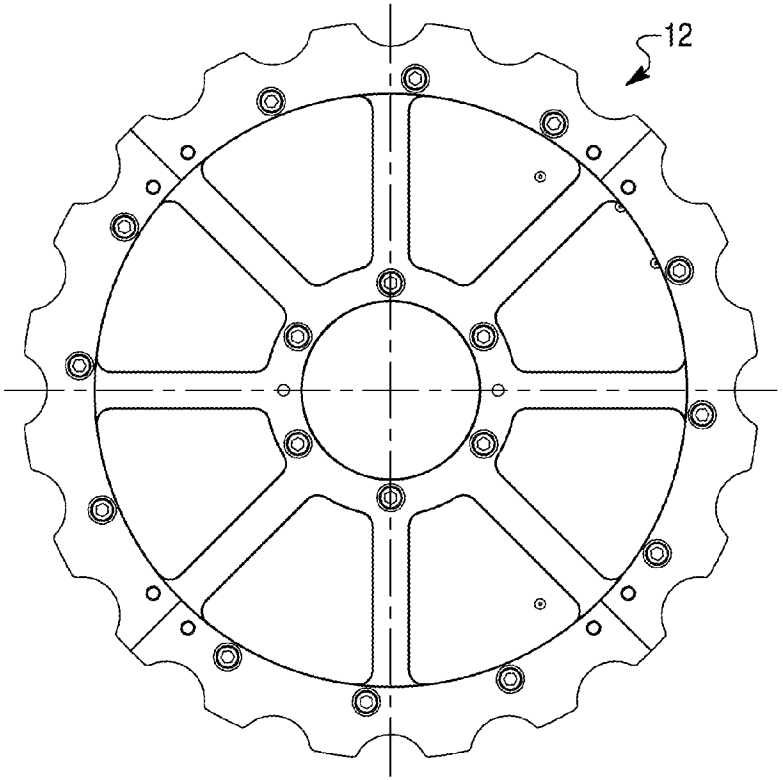
FIG. 7 is a top view of a transfer or discharge starwheel.

In embodiments, the drive shaft 201 may extend in a vertical direction 500, along a longitudinal axis 1001-1001 of the forming turret assembly 200, from the lower base 10 to the upper base 1000 of the frame 202. The drive shaft 201 may connect to the lower base 10 and the upper base 1000 via any suitable connectors (e.g. bearings, couplings, drive gear). The drive shaft 201 may support the fixed turret portion 216 and the axially moveable turret portion 215 (FIG. 8). The drive shaft 201 may be driven by a drive mechanism 101 (FIG. 3). Cams 23, 43 may connect to a base support located concentric to the drive shaft 201 where rotation of the drive shaft 201 causes the reciprocating and satellite motion of ram assemblies while interceding with the cams 23, 43. 270 degrees of the cam 23 is used for the forming operation in each stage.

The fixed turret portion 216 extends in the vertical direction 500 along the drive shaft 201. The fixed turret portion 216 is fixed so that the orientation (e.g. bottom line) of the container 1 that enters and exits the rotatable forming apparatus 100 relative to the mechanism (e.g. infeed and discharge conveying system), which helps move the container 1 through all stages of the rotatable forming apparatus 100, does not change. This allows for easier setup and control of the rotatable forming operation.

Figure 6:
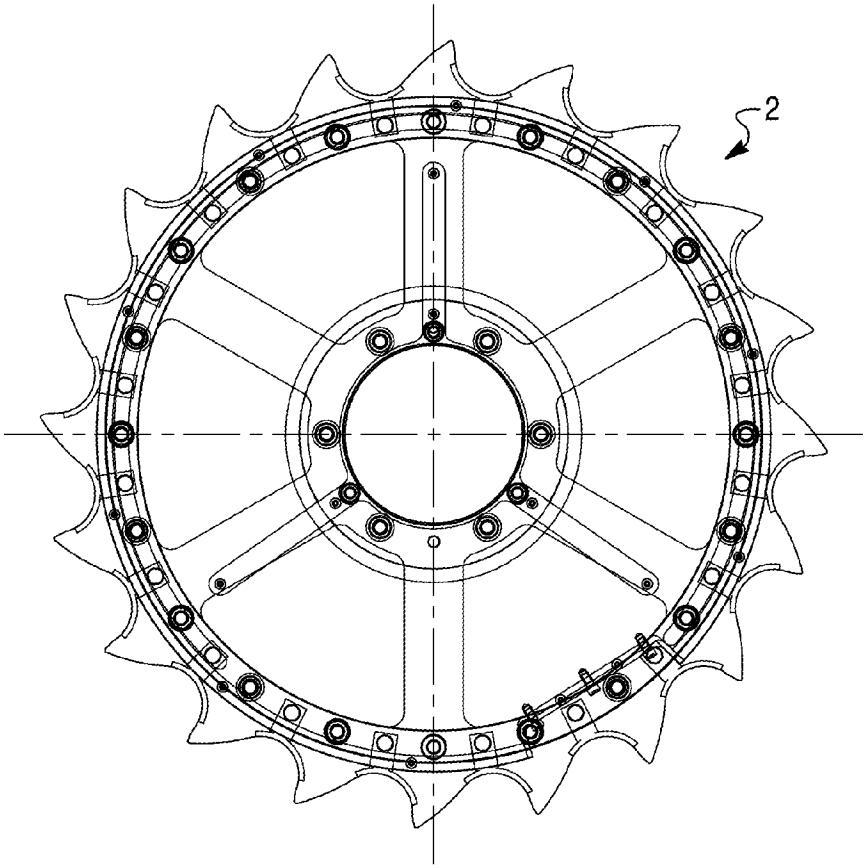
FIG. 6 is a top view of an infeed starwheel.
Figure 12:
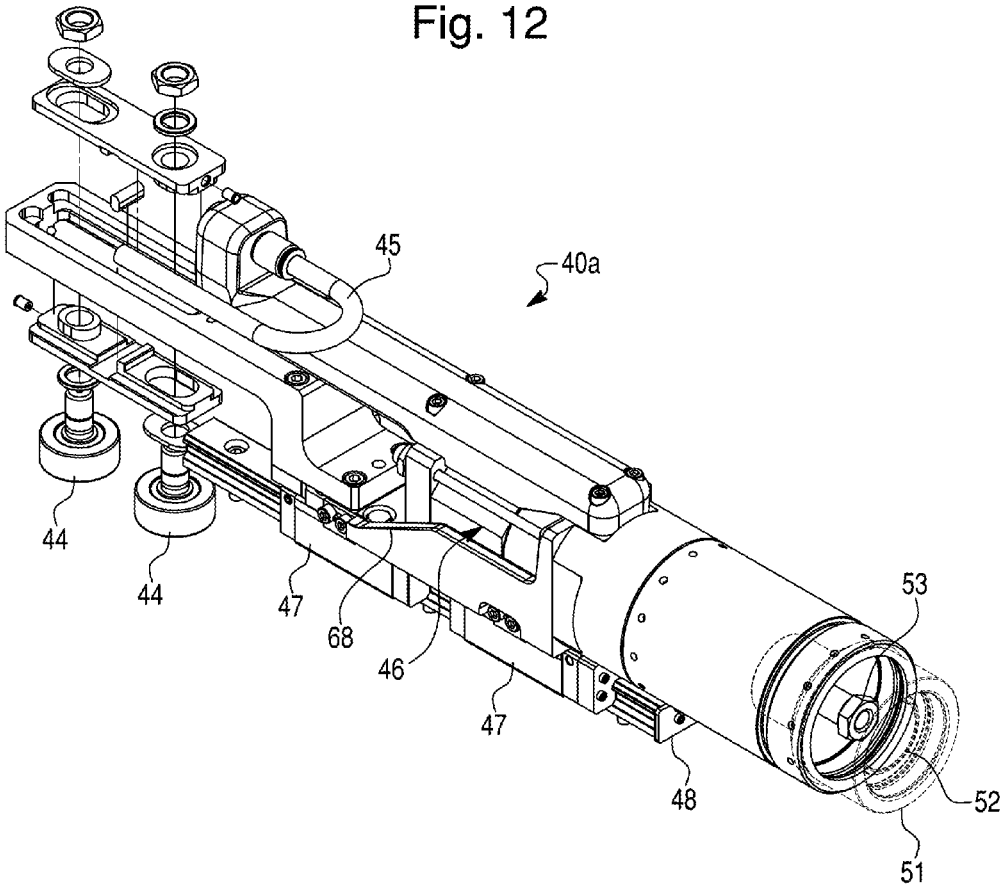
FIG. 12 is a ISO, partially exploded view of a forming ram assembly, with a forming die and knockout tooling device, of a rotatable forming apparatus.
Figure 13:
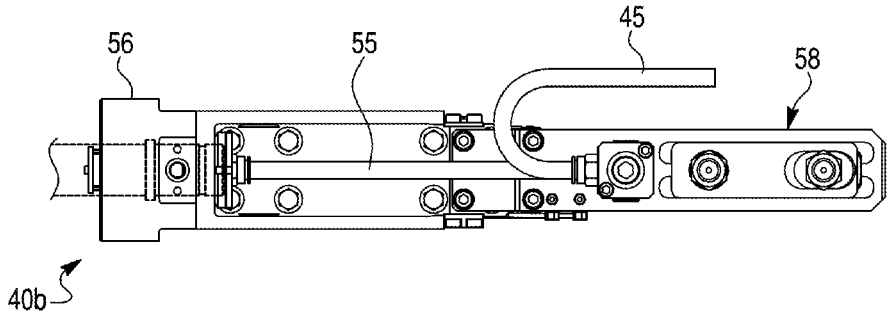
FIG. 13 is a front, assembled view of the forming ram assembly.
Figure 14:
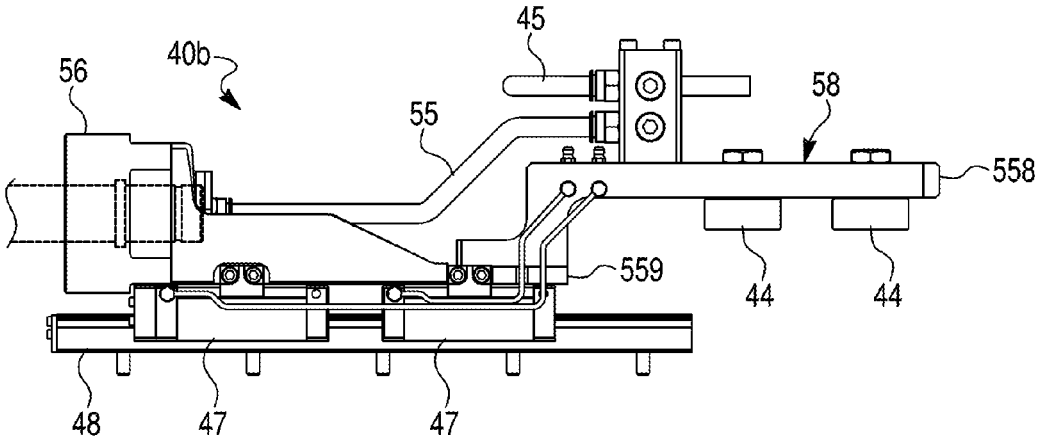
FIG. 14 is a side, assembled view of the forming ram assembly of FIG. 13.
Figure 15:
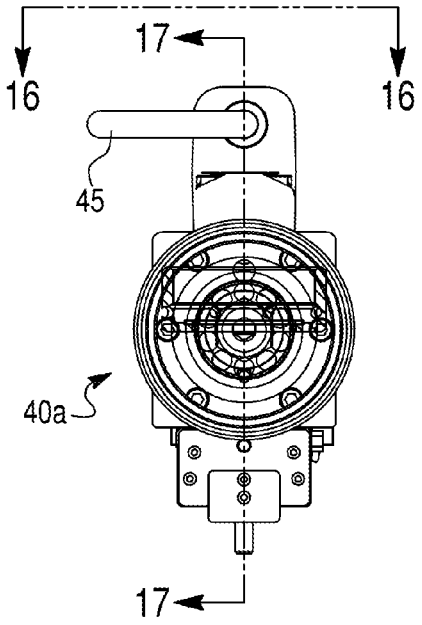
FIG. 15 is a bottom, assembled view of the forming ram assembly of FIG. 12.
Figure 16:
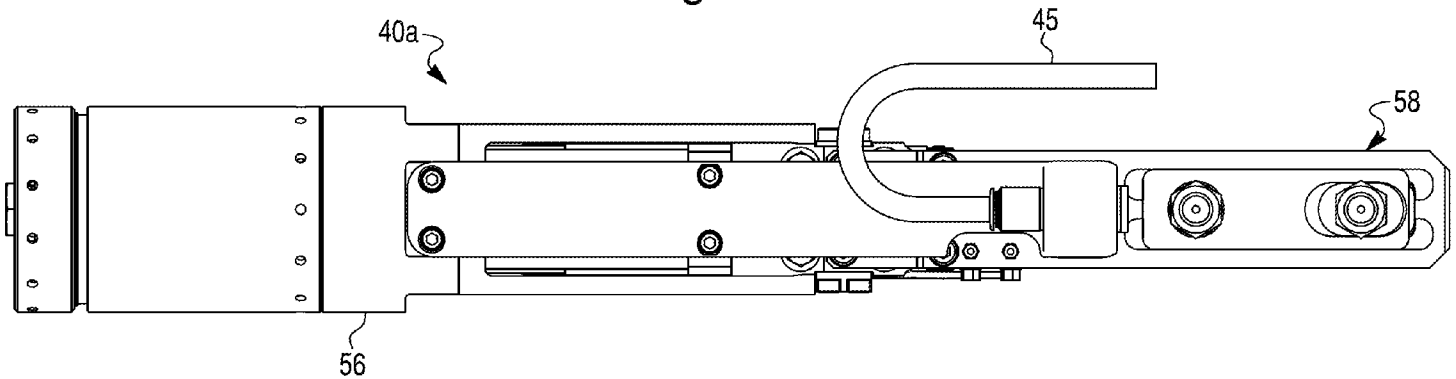
FIG. 16 is a view of FIG. 15 along line 16-16 where air lines are not shown.

The turret starwheel 102 (FIG. 3) is coaxial with the drive shaft 201. The turret starwheel 102 is configured to receive containers 1 from an infeed starwheel 2 or a transfer starwheel 12 (FIGS. 3 and 6). The transfer starwheels 12 are configured to receive the container 1 from the first stage process turret (e.g. forming turret assembly) and feed the container to the next stage process turret. The turret starwheel 102 may have any suitable number of components (e.g. six, eight, ten, twelve). The components may also be referred to as pockets. The turret starwheel 102 may have any suitable number of components (e.g. six, eight, ten, twelve) that a push ram assembly holds and may push the container 1 into a forming ram assembly in order to change the form/shape of the container. The forming ram assembly may also be referred to as a die ram assembly (FIGS. 12, 15-17) or expander ram assembly (FIGS. 13-14). The die ram assembly may neck the container while the expander ram assembly may expand the shape of the container.

The axially movable turret 215 (FIG. 8) extends in the vertical direction 500 along the drive shaft 201 and is above the fixed turret portion 216. The forming ram assemblies are located on the axially moveable turret portion 215. The forming ram assemblies communicate with a cam 43 that may connect to a base support located concentric to the drive shaft 201 (FIG. 9) and is oriented by a key connection with an upper bearing housing. Rotation of the drive shaft 201 causes the forming ram assemblies 40 to rotate around the cam 43. The axially moveable turret portion 215 may include an adjustment mechanism 70, 71, 72, 73, 74, 75, 205 (FIGS. 10-11). 270 degrees of the cam 43 is used for the forming operation in each stage. The adjustment mechanism 70, 71, 72, 73, 74, 75, 205 is configured to adjust the axially moveable turret portion 215 in the vertical direction 500 along the drive shaft 201 with respect to the fixed turret portion 216 so as to configure the forming turret assembly 200 readily adjustable for containers 1 of different lengths.

The forming ram assemblies 40, 40*a*, 40*b* (FIGS. 12-17) extend around and connect to the axially movable turret 215. Each of the forming ram assemblies 40 connects to the outer circumferential surface of the axially movable turret 215. Each of the forming ram assemblies 40 includes at least two slide blocks 47, a profiled rail 48 extending through each of the at least two slide blocks 47 and a drive cylinder 46 configured to slide each of the at least two slide blocks 47 along the profiled rail 48 in the vertical direction 500.

Each of the slide blocks 47 includes ball bearings (not shown). The slide blocks 47 are configured to slide along the profiled rail 48 such that the forming ram assembly 40 moves up and down in the vertical direction 500 with respect to the fixed turret portion 216 and the axially moveable turret portion 215. A conventional forming ram assembly includes only one slide block. The increased number of slide blocks 47 of the disclosed forming ram assembly 40 allows for the forming assembly 100 to provide for a longer stroke distance of the forming ram assembly 40 and to increase the stability and life of the forming ram assembly. Each of the slide blocks 47 includes ball bearings (not shown).

The profiled rail 48 connects to the axially moveable turret portion 215 via connectors (e.g. nuts and bolts). The rail is "profiled" due to its shape. The rail 48 is cut or formed into the outline shown in FIGS. 12 and 14 and, therefore, is a profiled rail. Alternatively, the rail 48 may be cut or formed into any other suitable shape (profile). For example, the rail 48 may be formed to have a rectangular shape with grooves or ridges (FIGS. 12 and 14), a single rounded profile or a combination of rounded curves and angular or flat portions.

Each of the forming ram assemblies 40 also includes an adapter 58 (FIG. 14) that mounts to a bracket 68 (FIG. 12) which is attached to the slide blocks 47. One end 558 of the adapter 58 includes provisions for mounting cam followers 44 that are configured to follow the cam 43 (FIG. 8) as the forming ram assemblies rotate around the cam 43, where the cam 43 may be stationary. The other end 559 of the adapter 58 includes provisions for mounting to the bracket 68 and to the slide blocks 47. The rotation of the axially moveable turret portion 215 and the interaction between the cam followers 44 and the cam 43 causes the slide blocks 47 to slide along the profiled rail 48 with respect to the drive shaft 201.

Each of the forming ram assemblies 40, 40*a*, once assembled with tooling components, (FIGS. 12 and 15-17) includes a forming die 51, a knockout tooling device 52 and a drive cylinder 46. The drive cylinder 46 may comprise a pneumatic cylinder. The drive cylinder 46 may be referred to as a knockout cylinder. The drive cylinder 46 may move in a downward vertical direction 500 due to gravity and air line pressure variation due to air path resistance. The drive cylinder 46 receives air line pressure variation from an air manifold assembly that fixes to the drive shaft 201 and rotates with the drive shaft 201. Once a container 1 contacts the knockout tooling device 52, the drive cylinder 46 moves in the vertical direction 500 that results from the forming die following the cam 43, thereby allowing the container 1 to go over the knockout tooling device 52 while forming of the container 1 occurs. Pressure is kept inside the container 1 while forming occurs to help with the forming operation.

The forming die 51 operatively connects to the cam followers 44 such that the forming die 51 moves in the vertical direction 500 and satellite rotation to follow the cam 43 profile. The forming die 51 of each of the forming ram assemblies 40*a* for an axially moveable turret portion 215 may be the same in an in-line system, but may differ from the forming ram assemblies 40*a* of any other axially moveable turret portion 215 in the rotatable forming apparatus 100 such that the shape of a container 1 is altered one way in the one axially movable turret 215 that the container 1 interacts with and is altered a second way in the other axially moveable turret portion 215 that the container 1 interacts with. In a recirculating system, the forming dies 51 of the forming ram assemblies 40 may not be the same. For example, the first, third, fifth, etc. forming dies 51 may be the same while the second, fourth, sixth, etc. forming dies 51 may differ from the first, third, fifth, etc. forming dies. The axially moveable turret portion 215 proceeding the first axially moveable turret portion 215 that the containers 1 enter includes forming dies 51 that differ from the forming dies 40 of the preceding axially moveable turret portion 215. The forming die 51 in both an in-line and recirculating system may first neck the container 1 and then expand the container 1 along the system such that the container 1 that exits the system resembles the container 1 in FIG. 1B.

The knockout tooling device 52 helps to release the container 1 from the forming die 51 after the forming die 51 necks the container 1. The knockout tooling device 52 catches a leading edge of the container 1 while the container 1 is being necked by the forming die 51 to prevent the container 1 from having an irregular shape. The knockout tooling device 52 is coaxial with the forming die 51.

Figure 17:
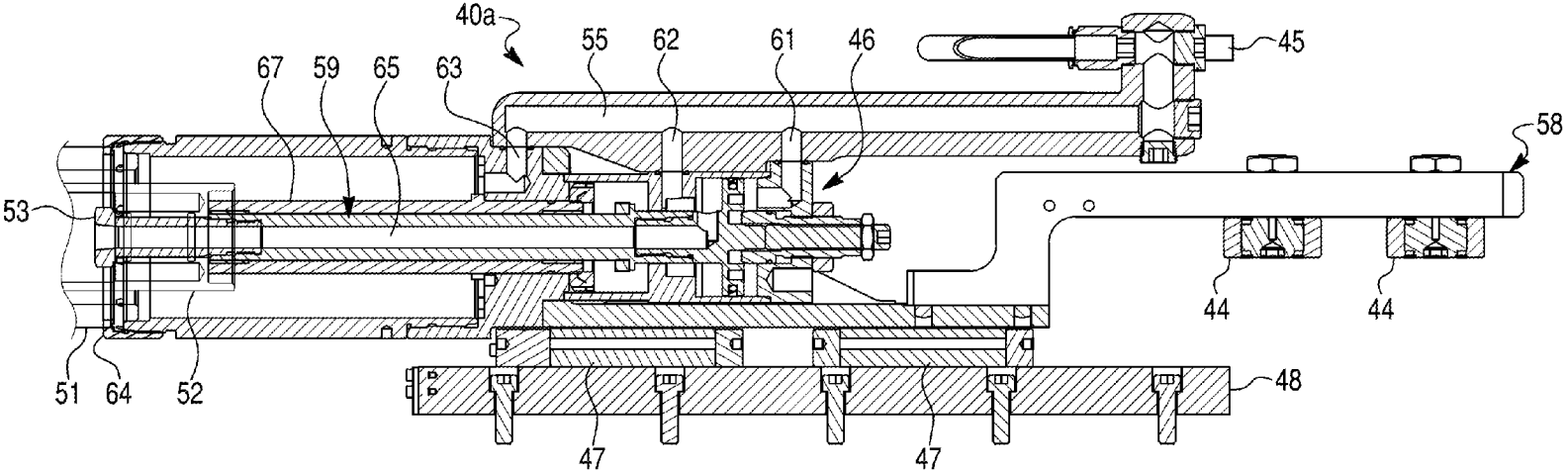
FIG. 17 is a cross-sectional view of FIG. 15 along line 17-17.
Figure 18:
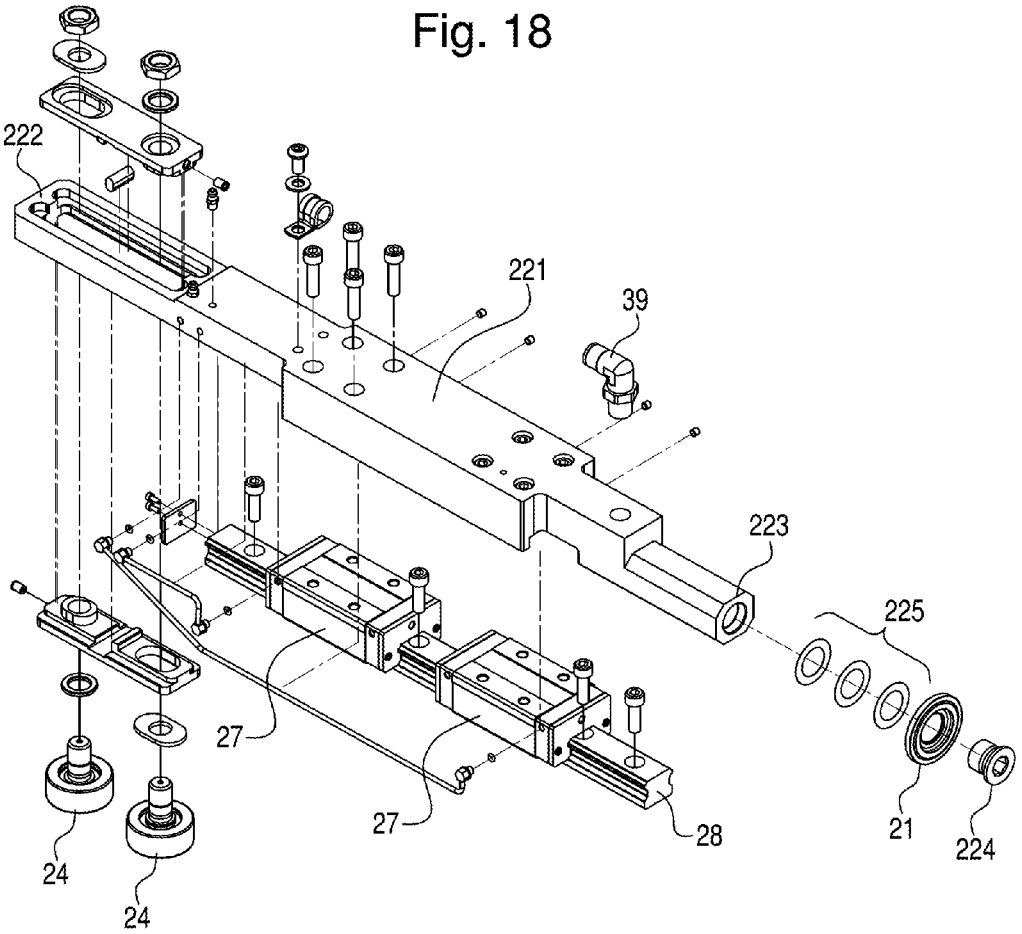
FIG. 18 is a ISO, exploded view of a push ram assembly of a rotatable forming apparatus.
Figure 19:
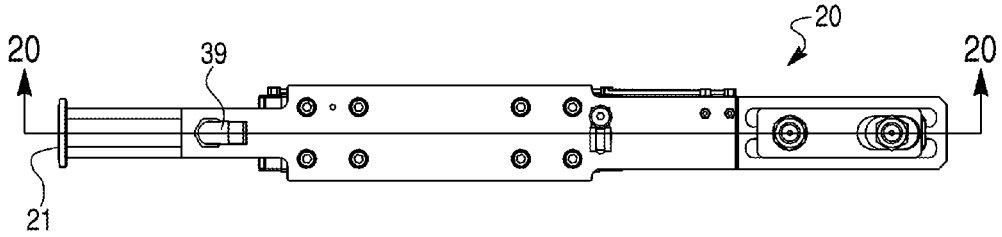
FIG. 19 is a front, assembled view of the push ram assembly of FIG. 18.
Figure 20:
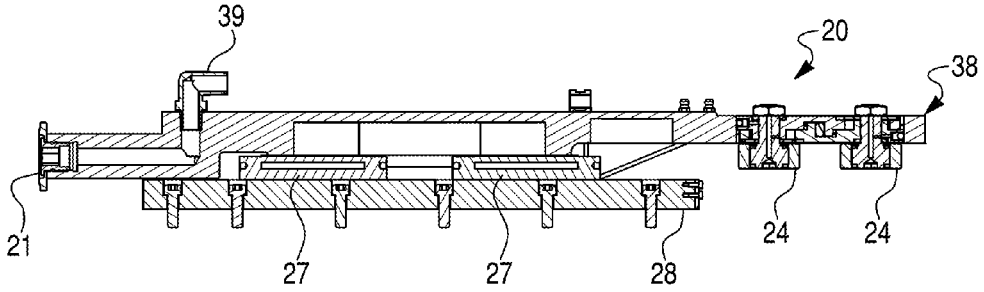
FIG. 20 is a cross-sectional view of FIG. 19 along line 20-20.
Figure 21:
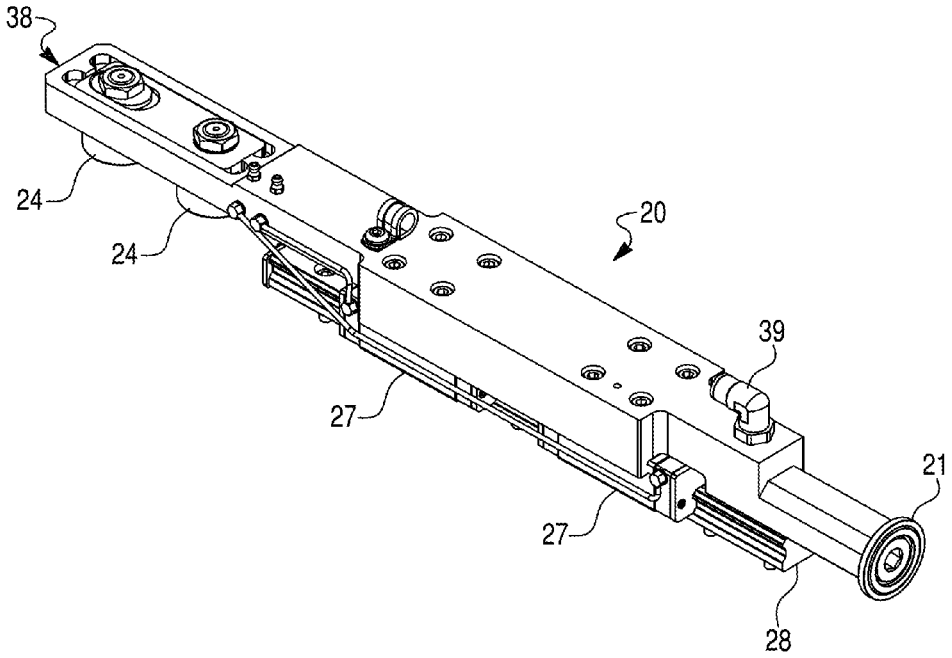
FIG. 21 is a ISO, assembled view of the push ram assembly of FIG. 18.

The drive cylinder 46 (FIG. 12) causes axial movement of the knockout tooling device 52 and is configured to operate independently of the forming die 51. The drive cylinder 46 connects to the forming ram assembly 40, 40*a* at an opening of the forming ram assembly 56. As shown in FIG. 17, the drive cylinder 46 includes a drive cylinder shaft 59 that extends parallel to the drive shaft 201. The knockout tooling device 52 connects to the drive cylinder shaft 59 via a bolt 53 that extends into the drive cylinder shaft 59 when the knockout tooling device 52 connects to the drive cylinder shaft 59. The knockout tooling device 52 connects to an inner surface of the container 1. The knockout tooling device 52 includes a knockout tooling device shaft 59 that is coaxial to and extends around a guide cylinder shaft 67. When the drive cylinder 46 receives air, the drive cylinder shaft 59 moves downwards due to air flow that causes the differential pressure, thereby causing the knockout tooling device 52 to move in the vertical direction 500 along the drive shaft 201.

The drive cylinder 46 may include a drive cylinder air passage 65. The drive cylinder air passage 65 extends through the drive cylinder shaft 59. When the drive cylinder air passage 65 receives air, the air enters a container 1 that interacts with the forming die 51 so that the container 1 does not collapse upon itself when the shape of the container 1 is modified by the forming die 51. An outer surface 64 of the drive cylinder 46 may connect to the forming die 51.

As shown in FIGS. 8 and 12-17, each of the forming ram assemblies 40 may also include an air input conduit 45, 55. The air input conduit 45 receives air from a pressure manifold. The air delivery conduit 45, 55 connects to a first conduit 61, a second conduit 62 and a third conduit 63. The first conduit 61 communicates with the drive cylinder 46, the second conduit 62 communicates with the inside of the container 1 and the third conduit 63 communicates with the inside and outside of the formed container 1. Air delivered to the first conduit 61, moves the piston of the drive cylinder 46. Air delivered to the second conduit 62 enters the inside of the container 1 so that the container 1 does not collapse upon itself. Generally, air delivered to the second conduit 62, helps the shape of the container 1 when it is modified by the forming die 51. Air delivered to the third conduit 63 keeps and prevents leaks through the knockout tooling device 52 and the container 1. Upon introduction of the container 1 into the forming die 51, the differential pressure that forced the knockout tooling device 52 downwards is substantially reduced or eliminated, thereby allowing the knockout tooling device 52 to move freely with the container motion for a limited displacement.

As shown in FIGS. 2, 8-9, 11 and 18-21, push ram assemblies 20 (lifter ram assemblies) may extend around and connect to the fixed turret portion 216. Each of the push ram assemblies 20 is configured to move the container 1, such that it contacts one of the forming ram assemblies 40. The push ram assemblies 20 may be referred to as lifter ram assemblies because they move in the vertical direction 500 to lift or lower the container 1 in the vertical direction 500.

As shown in FIGS. 18-21, each of the push ram assemblies 20 may include at least two slide blocks 27 and a profiled rail 28 extending through each of the at least two slide blocks 27. The slide blocks 27 are configured to slide along the profiled rail 28 such that the push ram assembly 20 moves up and down in the vertical direction 500 with respect to the fixed turret portion 216 and the axially moveable turret portion 215. A conventional push ram assembly includes only one slide block. The increased number of slide blocks 27 of the push ram assembly 20 allows for the forming assembly 100 to provide for a longer stroke distance of the push ram assembly 20 and to increase the stability of the push ram assembly 20 because the increased number of slide blocks 27 covers a greater distance than a single slide block 27. Each of the slide blocks 27 includes ball bearings (not shown).

The profiled rail 28 connects to the fixed turret portion 216 via connectors (e.g. nuts and bolts). The rail is "profiled" due to its shape. The rail 28 is cut or formed into the outline shown in FIGS. 18 and 21 and, therefore, is a profiled rail. Alternatively, the rail 28 may be cut or formed into any other suitable shape (profile). For example, the rail 28 may be formed to have a rectangular shape with grooves or ridges (FIGS. 18 and 21), a single rounded profile or a combination of rounded curves and angular or flat portions.

Each of the push ram assemblies 20 also may include an adapter 221 (FIG. 18) that mounts to the slide blocks 27. One end 222 of the adapter 221 includes provisions for mounting cam followers 24. The other end 223 of the adapter includes provisions for mounting a push plate device 21 (e.g. a pad). The push plate device 21 may mount to the adapter via a bolt 224 and bushings 225. The push plate device 21 is a vacuum push plate device and the push plate 21 moves up or down in the vertical direction 500 with respect to the longitudinal axis 1001-1001. The cam followers 24 follow the cam 23. U.S. Pat. No. 7,530,445, which is herein incorporated by reference in its entirety, describes a similar push ram assembly. Unlike the push ram assembly in U.S. Pat. No. 7,530,445, the push ram assembly 20 has at least two slide blocks 27 and is designed to work for a vertical rotatable forming apparatus.

Figure 10:
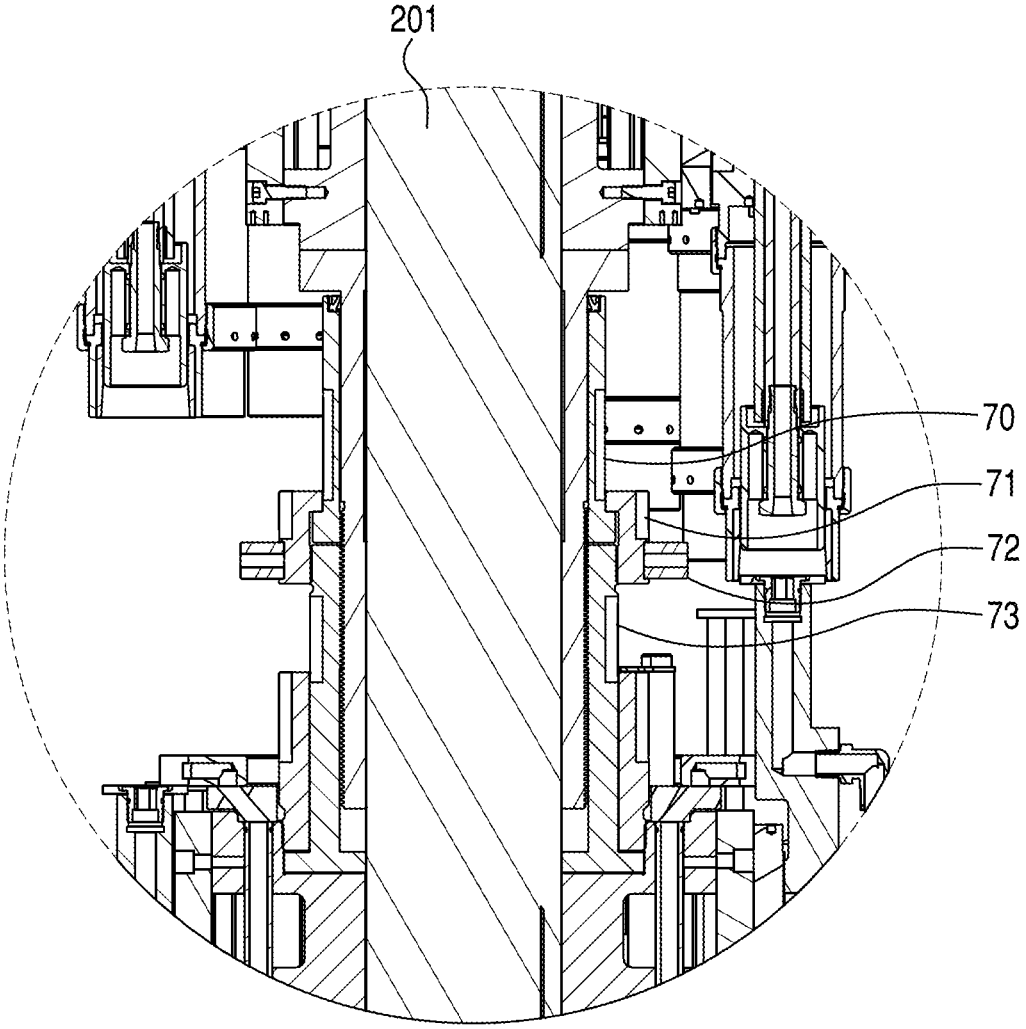
FIG. 10 is a detailed view of section 10 of FIG. 9.

As shown in FIG. 10, the forming turret assembly 200 may also include a jam nut 70 connected to the drive shaft 201 and an adjuster nut 73 pinned to the jam nut 70 so that the adjuster nut 73 rotates with the jam nut 70. Additionally, the forming turret assembly 200 may include a slit jam nut 71 and split clamp collar 72 configured to attach to the jam nut 70 and an expanding key such that the axially movable turret 215 does not move in the vertical direction 500 along the drive shaft 201 and may be configured to detach from the jam nut 70 such that the axially movable turret 215 moves in the vertical direction 500 along the drive shaft 201. The split clamp collar 72 may fix the slit jam nut 71 to the jam nut 70. When the slit jam nut 71 is released from the jam nut 70 and the expanding key tapered screw is released, the axially moveable turret portion 215 moves in the vertical direction 500. To the contrary, when the slit jam nut 71 is pulled down by the jam nut 71, the split clamp collar 72 is clamped and the expanding key's taper screw is fully tightened so that the axially moveable turret portion 215 remains stationary. Additionally, the forming turret assembly 200 may include a turret alignment tool 205 (FIG. 8) which helps align the forming turret assembly 200 with respect to the transfer turret assembly.

Figure 11:
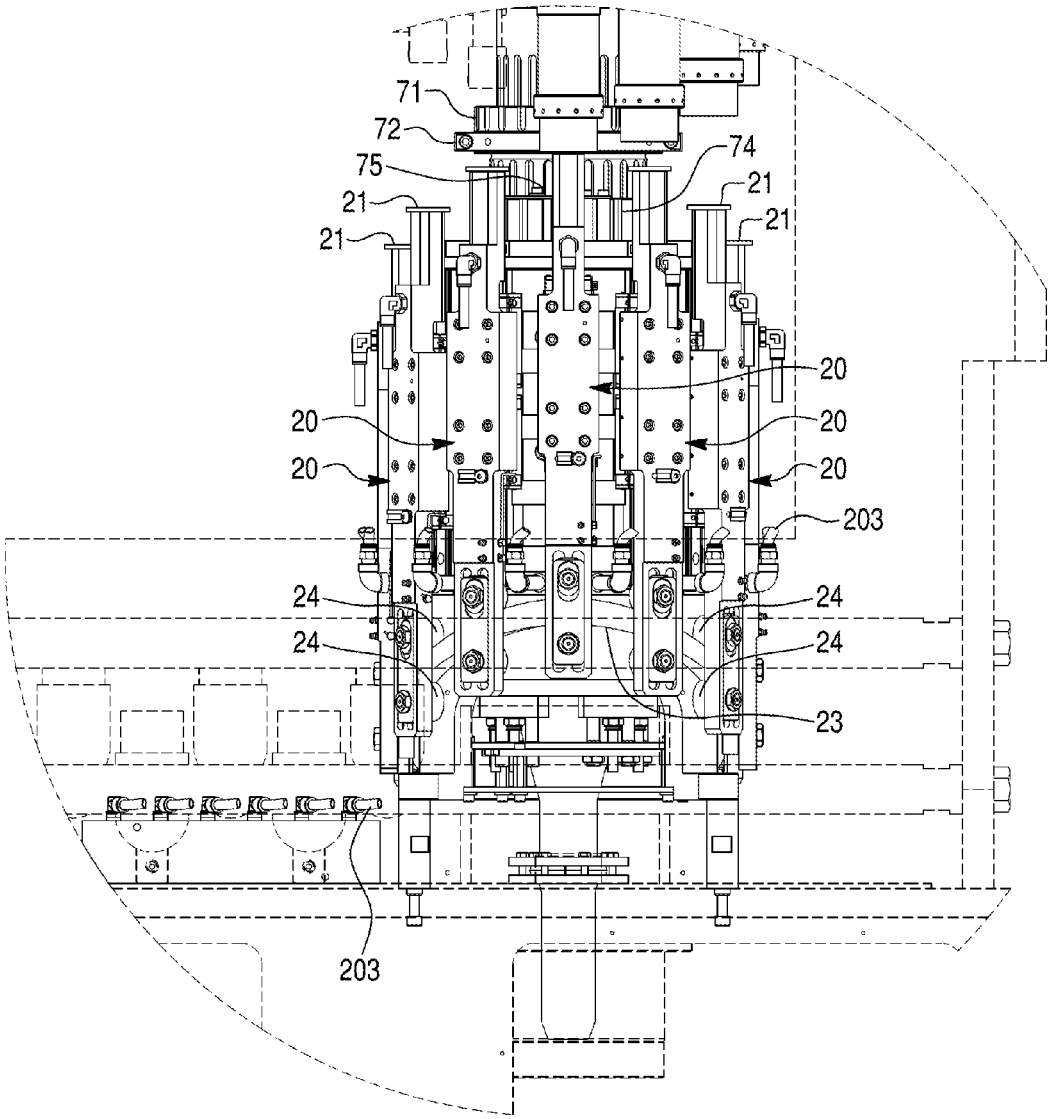
FIG. 11 is a detailed view of section 11 of FIG. 8.

As shown in FIG. 11, the forming turret assembly 200 may also include a spanner nut 74, screws 75, collars 76 and a clamp collar 72. Before adjusting the height of the axially movable turret 215, to turn the spanner nut 74, the screw 75 and clamp collar 77 must be loosened or removed. The jam nut 70, adjuster nut 73, slit jam nut 71, split clamp collar 72, spanner nut 74, screws 75, collars 76 and clamp collar 77 may form the adjustment mechanism. The adjustment mechanism may be manually activated.

The rotatable forming apparatus 100 may also include a transfer turret assembly 300 (FIGS. 3 and 5) that extends from and connects to the lower base 10 of the frame 202. The transfer turret assembly 300 connects to the forming turret assembly through the lower base 10 of the frame 202 at the lower base 310 of the transfer turret assembly 300 via bearing and drive gear. An infeed/discharge starwheel 2 or a transfer starwheel 12 connects to the transfer turret assembly 300 via connectors (e.g. nuts, bolts) at the upper base 311 of the transfer turret assembly 300.

The rotatable forming apparatus 100 may also include a lubrication mechanism (not shown). The lubrication mechanism lubricates each container 1 to ensure that the container 1 easily passes through the rotatable forming apparatus 100. The lubrication mechanism may include a lubricating track that is connected to or part of the infeed starwheel 2 of the rotatable forming apparatus 100. An example of a lubrication mechanism can be found in U.S. Patent Application No. PCT/US2010/024988, which is herein incorporated by reference in its entirety.

The rotatable forming apparatus 100 may be part of an in-line system (not shown) or a recirculating system (not shown). In an in-line system (FIG. 22), each and every turret assembly 200 extends in a single line such that the containers 1 operated on in the system only move through the rotatable forming apparatus in a single pass. In an in-line system, each forming turret assembly 200 includes the same type of forming die where the forming die on each successive forming turret assembly 200 in the single pass includes a different forming die from the previous forming turret assembly 200 in the single pass. In this way, the shape of the containers 1 is progressively modified.

If the rotatable forming apparatus 100 is part of a recirculating system, the rotatable forming apparatus 100 includes a recirculation mechanism (not shown) that is configured to receive the container 1 and return the container 1 to the infeed starwheel 2. The recirculation mechanism may move the containers 1 from a downstream one of the turret assemblies 200, 300, after a first run (or pass) through the rotatable forming apparatus 100, and recirculates the containers 1 to an upstream one of the turret assemblies 200, 300. The upstream turret assemblies 200, 300 may be those at or close to the transfer turret assembly 300 connected to the infeed starwheel 2. The containers 1 recirculated pass through a second run (or pass) in the rotatable forming apparatus 100 to subject the containers 1 through the successive forming operations of the forming turret assemblies 200. When the containers 1 pass through the second run, the containers 1 do not pass through forming operations that are identical to the first run. Rather the containers 1 in the second pass are in different pockets of the starwheels for different forming operations.

Figure 23:
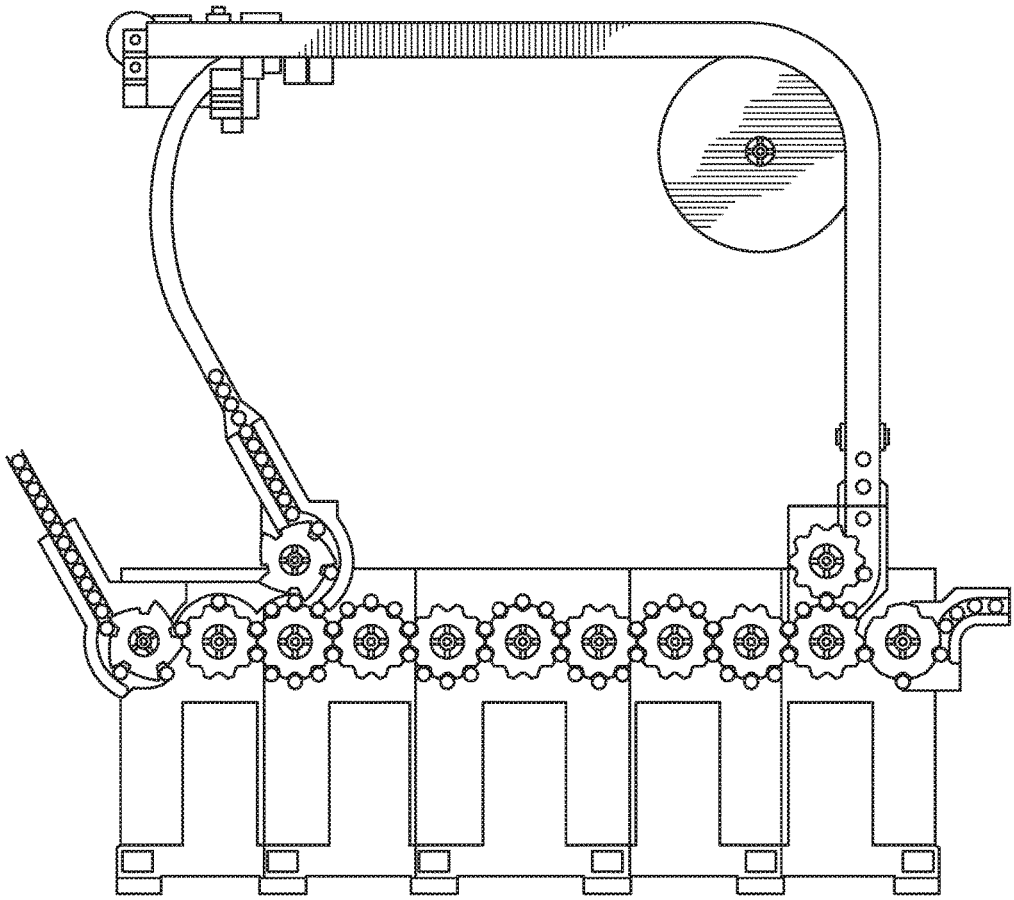
FIG. 23 is a schematic view of a machine arrangement with a recirculation conveyor system according to an embodiment of the invention.

The rotatable forming apparatus 100 may include any suitable number of passes (or runs), such as two, three, four, five, etc. runs. The starwheel of each forming turret assembly 200 and each transfer turret assembly 300 will include the appropriate number of varying pockets for the applicable number of passes. For example, if the rotatable forming apparatus 100 includes three passes, each turret starwheel 102 will include three different types of pockets. Examples of recirculation mechanisms can be found at FIG. 23 and in U.S. Pat. No. 7,886,894, which is herein incorporated by reference in its entirety.

For both an in-line system and a recirculating system, the method for modifying the shape of the container includes feeding a container 1 into a continuously rotating first forming turret assembly 200 that includes a first axially moveable turret portion 215 and first forming ram assemblies 20 extending around and connected to the first axially movable turret 215 where each of the first forming ram assemblies 20 includes a first drive cylinder 46, a first forming die 51 and a first knockout tooling device 52. A continuously rotating first transfer turret assembly 300 feeds the container 1 to the first forming turret assembly 200.

Once the container 1 enters the first forming turret assembly 200, the first drive cylinder 46 is activated to cause axial movement of the first knockout tooling device 52 in a vertical direction 500 along a longitudinal axis 1001-1001. The first drive cylinder 46 is activated when a suitable amount of air enters the first drive cylinder 46. The air enters the drive cylinder 46 when air enters the input conduit 45 and flows from the input conduit 45 to the air delivery conduit 55, from the air delivery conduit 55 to the third conduit 63 and from the third conduit 63 to the inside of the drive cylinder 46.

Once the container 1 enters the first forming turret assembly 200, the first forming die 51 is activated independently of the activated first drive cylinder 46 to cause axial movement of the first forming die 51 in the vertical direction 500 along the longitudinal axis 1001-1001 and rotational movement of the first forming die 51. Axial and rotational movement of the first forming die 51 occurs when the turret rotates around the fixed cams 23, 43, first drive cylinder 46 activates. The first drive cylinder 46 activates when a suitable amount of air is delivered. The air enters the first drive cylinder 46 when the air that enters the input conduit 45 flows from the input conduit 45 to the air delivery conduit 55, from the air delivery conduit 55 to the first conduit 61 and from the first conduit 61 to the drive cylinder 46 (FIG. 12). While the first forming turret assembly 200 rotates with the container 1, the container 1 is inserted into the first forming die 51 and the shape of the open end or top of the container 1 is modified by the first forming die 51 and then withdrawn. The first forming die 51 is able to apply a neck to the container 1, that is some embodiments may be 200 mm from the top of the container 1.

After the container 1 is shaped by the first forming die 51, the container 1 is transferred to a second transfer turret assembly 300 that includes a transfer starwheel 12 and subsequently transferred to a second forming turret assembly 200 that includes a second axially moveable turret portion 215 and second forming ram assemblies 20 extending around and connected to the second axially movable turret 215. Each of the second forming ram assemblies 20 includes a second drive cylinder 46, a second forming die 51 and a second knockout tooling device 52. The second forming turret assembly 200 operates similarly to the first forming turret assembly 200, but includes different forming dies to modify further the shape of the container 1.

For a recirculating system, the container 1 may be fed from the second forming turret assembly 200 back to the first forming turret assembly 200 if there are only two second forming turret assemblies. There can be any number of forming turret assemblies. For example, the container 1 may be fed from the second forming turret assembly 200 to one or more forming turret assemblies 200. Regardless of the number of forming turret assemblies 200, the container may be recirculated to the first forming turret assembly 200. For an in-line system, the container 1 moves from one forming turret assembly to another forming turret assembly until the forming process of the container 1 is complete. In both a recirculated and in-line system, the containers 1 continue to be fed from one forming turret assembly to another forming turret assembly via a transfer turret assembly. To facilitate transferring the container 1 to and from the forming turret assembly 200 to the transfer turret assembly 300, the rotatable forming apparatus 100 may include external guide rails (not shown).

The starwheels 2, 12, 102 may be arranged in embodiments to hold containers 1 in position using suction received from a vacuum supply 203 (FIG. 8) that communicates with vacuum transfer tubes 22, 41 (FIG. 8). Each starwheel 2, 12, 102 may have a vacuum port (not shown), formed in a channel portion, that fluidly communicates with the vacuum supply 203 (e.g. negative pneumatic pressure) via a suitable manifold. The vacuum is delivered to the vacuum ports and the surface area of the containers 1, that are exposed to the suction, is increased to a degree that the containers 1 are stably held in position as the shape of each container 1 is modified by the forming die.

As a result of the above-described rotatable forming apparatus 100, in embodiments 1200 containers/minute may be processed by the forming apparatus 100 in comparison to conventional forming apparatuses which process only 200 containers/minute. Moreover, as a result of the above-described rotatable forming apparatus 100, easy access of the forming dies, assembly and maintenance is possible.

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described are considered to be within the scope of the disclosure.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples or preferred examples).

It should be noted that the orientation of various elements may differ according to other exemplary embodiments, and that such variations are intended to be encompassed by the present disclosure. It is recognized that features of the disclosed embodiments can be incorporated into other disclosed embodiments.

It is important to note that the constructions and arrangements of the rotatable forming apparatus or components thereof as shown in the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited in the claims. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present disclosure.

What is claimed is:

1. A rotatable forming apparatus for modifying a shape of a container, comprising: a frame having a lower base and an upper base, the lower base having a bottom surface and a generally opposing top surface, the bottom surface contacting a support surface; a forming turret assembly connected to the frame and including: a drive shaft extending in a vertical direction along a longitudinal axis from the top surface of the lower base to the upper base; a fixed turret portion extending in the vertical direction along the drive shaft; a turret starwheel coaxial with the drive shaft, wherein the turret starwheel is configured to receive the container; an axially movable turret portion extending in the vertical direction along the drive shaft and above the fixed turret portion, the axially moveable turret portion including a cam and an adjustment mechanism configured to adjust the axially moveable turret portion in the vertical direction along the drive shaft with respect to the fixed turret portion so as to configure the forming turret assembly readily adjustable for containers of different lengths; forming ram assemblies extending around and connected to the axially movable turret portion, wherein each of the forming ram assemblies includes: cam followers configured to follow the cam as the cam rotates; a forming die operatively connected to the cam followers such that the forming die moves in the vertical direction while following the cam; a knockout tooling device; and a drive cylinder that causes axial movement of the knockout tooling device and is configured to operate independently of the forming die.

2. The rotatable forming apparatus of claim 1, wherein the forming turret assembly further includes a jam nut connected to the drive shaft and an adjuster nut pinned to the jam nut so that the adjuster nut rotates with the jam nut.

3. The rotatable forming apparatus of claim 2, wherein the forming turret assembly further includes a slit jam nut and split clamp collar configured to attach to the jam nut such that the axially movable turret does not move in the vertical direction along the drive shaft and is configured to detach from the jam nut such that the axially movable turret portion moves in the vertical direction along the drive shaft.

4. The rotatable forming apparatus of claim 3, wherein the split clamp collar fixes the slit jam nut to the jam nut.

5. The rotatable forming apparatus of claim 1, wherein each of the forming ram assemblies is connected to the outer circumferential surface of the axially movable turret portion.

6. The rotatable forming apparatus of claim 1, wherein each of the forming ram assemblies further includes at least two slide blocks, a profiled rail extending through each of the at least two slide blocks and a drive cylinder configured to slide each of the at least two slide blocks along the profiled rail in the vertical direction via the interaction between the cam followers and the cam.

7. The rotatable forming apparatus of claim 6, wherein each of the forming ram assemblies further includes an air conduit that connects to a first conduit, a second conduit and a third conduit, wherein the first conduit communicates with the drive cylinder, the second conduit communicates with the inside of the container and the third conduit communicates with the inside of the drive cylinder.

8. The rotatable forming apparatus of claim 1, wherein the drive cylinder includes an outer surface that connects to the forming die and an inner surface that connects to the knockout tooling device.

9. The rotatable forming apparatus of claim 1, wherein the drive cylinder includes a drive cylinder shaft that extends parallel to the drive shaft.

10. The rotatable forming apparatus of claim 9, wherein the knockout tooling device includes a knockout tooling device shaft that is coaxial to and extends around a guide cylinder shaft.

11. The rotatable forming apparatus of claim 1, wherein the drive cylinder comprises a pneumatic cylinder.

12. The rotatable forming apparatus of claim 1, further comprising a transfer turret assembly extending from and connected to the lower base of the frame and including one of an infeed starwheel that receives the container and transfers the container to the turret starwheel and a transfer starwheel that receives the container from the turret starwheel and transfers the container to another turret starwheel.

13. The rotatable forming apparatus of claim 12, further comprising a recirculation mechanism that is configured to receive the container and return the container to the infeed starwheel.

* * * * *